US008480919B2

(12) United States Patent
Kaneko et al.

(10) Patent No.: US 8,480,919 B2
(45) Date of Patent: Jul. 9, 2013

(54) LUBRICATING OIL COMPOSITION FOR REFRIGERATORS

(75) Inventors: Masato Kaneko, Chiba (JP); Harutomo Ikeda, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 191 days.

(21) Appl. No.: 12/595,837

(22) PCT Filed: Apr. 18, 2008

(86) PCT No.: PCT/JP2008/057577

§ 371 (c)(1),
(2), (4) Date: Dec. 16, 2009

(87) PCT Pub. No.: WO2008/130026

PCT Pub. Date: Oct. 30, 2008

(65) Prior Publication Data

US 2010/0133463 A1 Jun. 3, 2010

(30) Foreign Application Priority Data

Apr. 18, 2007 (JP) ..... 2007-109705

(51) Int. Cl.
*C09K 5/04* (2006.01)

(52) U.S. Cl.
USPC ..... 252/68

(58) Field of Classification Search
USPC ..... 252/68
See application file for complete search history.

(56) References Cited

U.S. PATENT DOCUMENTS

| | | | | |
|---|---|---|---|---|
| 5,464,550 | A * | 11/1995 | Sasaki et al. | 252/68 |
| 5,653,909 | A | 8/1997 | Muraki et al. | |
| 6,074,573 | A * | 6/2000 | Kaneko | 252/68 |
| 6,306,803 | B1 | 10/2001 | Tazaki | |
| 6,410,492 | B1 | 6/2002 | Shimomura et al. | |
| 6,667,285 | B1 | 12/2003 | Kawahara et al. | |
| 2002/0193262 | A1 | 12/2002 | Kaimai et al. | |
| 2004/0089839 | A1 | 5/2004 | Thomas et al. | |
| 2007/0108403 | A1 * | 5/2007 | Sievert et al. | 252/67 |
| 2008/0157022 | A1 * | 7/2008 | Singh et al. | 252/68 |
| 2008/0157023 | A1 * | 7/2008 | Samuels et al. | 252/68 |
| 2011/0126558 | A1 * | 6/2011 | Thomas et al. | 62/77 |

FOREIGN PATENT DOCUMENTS

| | | |
|---|---|---|
| JP | 4 110388 | 4/1992 |
| JP | 7 507342 | 8/1995 |
| JP | 11 293273 | 10/1999 |
| JP | 2000 73080 | 3/2000 |
| JP | 2001 139972 | 5/2001 |
| JP | 2002 356694 | 12/2002 |
| JP | 2006 503961 | 2/2006 |
| JP | 2006 316147 | 11/2006 |
| WO | WO 2005/012467 A1 | 2/2005 |
| WO | 2005 103190 | 11/2005 |
| WO | 2007 026646 | 3/2007 |

OTHER PUBLICATIONS

Extended Supplementary European Search Report issued on Jun. 8, 2011 in corresponding European Application No. 08 74 0632.
U.S. Appl. No. 12/595,693, filed Oct. 13, 2009, Kaneko, et al.
U.S. Appl. No. 12/438,141, filed Feb. 20, 2009, Ota, et al.
Chinese Office Action dated Jul. 3, 2012.

* cited by examiner

*Primary Examiner* — John Hardee
(74) *Attorney, Agent, or Firm* — Oblon, Spivak, McClelland, Maier & Neustadt, L.L.P.

(57) ABSTRACT

A lubricating oil composition for refrigerators including (A) a base oil containing as a main component a polyol ester compound obtained from a polyhydric alcohol selected from among pentaerythritol, dipentaerythritol, trimethylolpropane and neopentyl glycol and a $C_4$ to $C_{20}$ aliphatic monocarboxylic acid, (B) a phosphorus-based additive comprised of a phosphoric acid triester and/or a phosphorous acid triester, and (C) at least one acid scavenger selected from among glycidyl esters, glycidyl ethers and α-olefin oxides.
The lubricating oil composition is applicable to such refrigerators that use a refrigerant having a specific structure, such as an unsaturated fluorinated hydrocarbon compound, and being usable in current car air conditioner systems, and has excellent compatibility with the refrigerant, good sealing properties, capability of imparting a low coefficient of friction to sliding members and, yet, excellent stability.

24 Claims, No Drawings

LUBRICATING OIL COMPOSITION FOR REFRIGERATORS

TECHNICAL FIELD

The present invention relates to a lubricating oil composition for refrigerators and, more specifically, to a lubricating oil composition for refrigerators which contains a base oil containing a specific polyol ester compound as a main component and which is used for refrigerators using a specific refrigerant, such as an unsaturated fluorinated hydrocarbon compound, having a low global warming potential and particularly being usable in current car air conditioner systems.

BACKGROUND ART

A compression-type refrigerator is generally comprised of at least a compressor, a condenser, an expansion mechanism (such as an expansion valve) and an evaporator or comprised additionally of a dryer, and is constructed such that a mixed liquid composed of a refrigerant and a lubricating oil (refrigerator oil) is circulated through a closed system including these devices. In such a compression-type refrigerator, in general, a high temperature is established within a compressor while a low temperature is established within a cooler, though depending upon the devices used. Therefore, it is necessary that the refrigerant and the lubricating oil can be circulated through the system without causing a phase separation in a wide temperature range encompassing from low temperatures to high temperatures. In general, the refrigerant and lubricating oil have temperature regions on a low temperature side and on a high temperature side in which they cause phase separation. The highest temperature in the low temperature side separation region is preferably −10° C. or lower, particularly preferably −20° C. or lower. On the other hand, the lowest temperature in the high temperature side separation region is preferably 30° C. or higher, particularly preferably 40° C. or higher. Phase separation during the operation of the refrigerator considerably adversely affects the service life and the operation efficiency of the apparatus. For example, if phase separation between the refrigerant and lubricating oil occurs in the compressor section, lubrication in a moving part will become insufficient so that seizing and other problems will occur to considerably reduce the service life of the apparatus. On the other hand, if phase separation occurs in the evaporator, the heat exchange efficiency is considerably reduced because of the presence of a highly viscous lubricating oil.

As a refrigerant for refrigerators, a chlorofluorocarbon (CFC), a hydrochlorofluorocarbon (HCFC), etc. have been hitherto mainly used. Because these compounds contain chlorine atoms which cause environmental problems, chlorine-free substitutional refrigerants such as a hydrofluorocarbon (HFC) have been investigated. Thus, hydrofluorocarbons, typically 1,1,1,2-tetrafluoroethane, difluoromethane, pentafluoroethane, 1,1,1-trifluoroethane (which are referred to as R134a, R32, R125 and R143a, respectively) have become a focus of attention. For example, R134a is actually used in a car air conditioning system.

Since there is apprehension that HFC may also have a problem with respect to global warming, however, a natural refrigerant such as carbon dioxide has become a focus of attention as a substitutional refrigerant. Because carbon dioxide requires a high pressure, however, it is impossible to use carbon dioxide in current car air conditioning systems.

As a refrigerant having a low global warming potential and being usable for a current car air conditioning system, there has been found a refrigerant having a specific polar structure in its molecule, such as an unsaturated fluorinated hydrocarbon compound (see, for example, Patent Document 1), a fluorinated ether compound (see, for example, Patent Document 2), a fluorinated alcohol compound or a fluorinated ketone compound.

A lubricating oil for refrigerators using such a refrigerant is required to have excellent compatibility with the refrigerant, good sealing properties, capability of imparting a low coefficient of friction to sliding members and, yet, excellent stability.

[Patent Document 1] Japanese Translation of PCT International Application Publication No. 2006-503961

[Patent Document 2] Japanese Translation of PCT International Application Publication No. H07-507342

DISCLOSURE OF THE INVENTION

Problem to be Solved by the Invention

With the above-described circumstance in view, it is an object of the present invention to provide a lubricating oil composition for refrigerators which is applicable to such refrigerators that use a refrigerant having a low global warming potential and a specific structure, such as an unsaturated fluorinated hydrocarbon compound, being usable in current car air conditioner systems and which has excellent compatibility with the refrigerant, good sealing properties, capability of imparting a low coefficient of friction to sliding members and, yet, excellent stability.

Means for Solving the Problem

The inventors have made an earnest study with a view toward accomplishing the above-described object and, as a result, found that the above-described object can be achieved by using a specific polyol ester compound as a base oil together with a specific phosphorus-based additive and a specific acid scavenger while preferably using a specific material in a sliding member of a refrigerator. The present invention has been completed based on the above finding.

Thus, the present invention provides as follows:

(1) A lubricating oil composition for refrigerators that use a refrigerant containing at least one fluorine-containing organic compound selected from among compounds represented by the following molecular formula (I):

$$C_pO_qF_rR_s \quad (I)$$

where R represents Cl, Br, I or H; p, q, r and s are integers of 1 to 6, 0 to 2, 1 to 14 and 0 to 13, respectively, with the proviso that p is 2 to 6 when q is 0, the fluorine-containing organic compound having at least one carbon-carbon unsaturated bond in the molecule, or a combination of the fluorine-containing organic compound with a saturated fluorinated hydrocarbon compound, the lubricating oil composition including (A) a base oil containing as a main component a polyol ester compound obtained from a polyhydric alcohol selected from among pentaerythritol, dipentaerythritol, trimethylolpropane and neopentyl glycol, and a $C_4$ to $C_{20}$ aliphatic monocarboxylic acid, (B) a phosphorus-based additive including a phosphoric acid triester and/or a phosphorous acid triester, and (C) at least one acid scavenger selected from among glycidyl esters, glycidyl ethers and α-olefin oxides;

(2) The lubricating oil composition for refrigerators as recited in above (1), in which the refrigerant is a $C_2$ to $C_3$ unsaturated fluorinated hydrocarbon refrigerant or a combination of a $C_1$ to $C_2$ saturated fluorinated hydrocarbon refrigerant with a $C_3$ unsaturated fluorinated hydrocarbon refrigerant;

(3) The lubricating oil composition for refrigerators as recited in above (1) or (2), in which the base oil has a kinematic viscosity at 100° C. of 2 to 50 $mm^2/s$;

(4) The lubricating oil composition for refrigerators as recited in any one of above (1) to (3), in which the base oil has a molecular weight of at least 300;

(5) The lubricating oil composition for refrigerators as recited in any one of above (1) to (4), in which the base oil has a flash point of at least 200° C.;

(6) The lubricating oil composition for refrigerators as recited in any one of above (1) to (5), further including at least one additive selected from the group consisting of another extreme pressure agent than that described above, an oiliness agent, an antioxidant, another acid scavenger than that described above and an anti-foaming agent;

(7) The lubricating oil composition for refrigerators as recited in any one of above (1) to (6), in which the refrigerators have a sliding member made of an engineering plastic or having an organic coating film or an inorganic coating film;

(8) The lubricating oil composition for refrigerators as recited in above (7), in which the organic coating film is a polytetrafluoroethylene coating film, a polyimide coating film, a polyamide-imide coating film or a thermosetting insulating film formed from a resin coating material containing a resin base material including a polyhydroxyether resin and a polysulfone-based resin, and a cross-linking agent;

(9) The lubricating oil composition for refrigerators as recited in above (7), in which the inorganic coating film is a graphite film, a diamond-like carbon film, a tin film, a chromium film, a nickel film or a molybdenum film;

(10) The lubricating oil composition for refrigerators as recited in any one of above (1) to (9), for use in various hot-water supplying systems or refrigeration and heating systems for car air conditioners, electric car air conditioners, gas heat pumps, air conditioners, refrigerators, vending machines or showcases; and

(11) The lubricating oil composition for refrigerators as recited in above (10), in which a water content and a residual air content within each of the systems are 300 ppm by mass or less and 10 kPa or less, respectively.

Effect of the Invention

According to the present invention, it is possible to provide a lubricating oil composition for refrigerators which is used for refrigerators using a refrigerant having a low global warming potential and specific structure, such as an unsaturated fluorinated hydrocarbon compound, and being particularly usable in current car air conditioner systems and which has excellent compatibility with the refrigerant, good sealing properties, capability of imparting a low coefficient of friction to sliding members and, yet, excellent stability.

BEST MODE FOR CARRYING OUT THE INVENTION

The lubricating oil composition for refrigerators according to the present invention is a composition for refrigerators that use a refrigerant containing at least one fluorine-containing organic compound selected from among compounds represented by the following molecular formula (I):

$$C_pO_qF_rR_s \quad (I)$$

where R represents Cl, Br, I or H, p, q, r and s are integers of 1 to 6, 0 to 2, 1 to 14 and 0 to 13, respectively, with the proviso that p is 2 to 6 when q is 0, the fluorine-containing organic compound having at least one carbon-carbon unsaturated bond in the molecule, or a combination of the fluorine-containing organic compound with a saturated fluorinated hydrocarbon compound.

Refrigerant:

The above molecular formula (I) shows the kind and number of each element in the molecule. Thus, represented by the above molecular formula (I) is a fluorine-containing organic compound having a number p of carbon atoms of 1 to 6. Such a $C_1$ to $C_6$ fluorine-containing organic compound can exhibit physical and chemical properties required as a refrigerant, such as a boiling point, a freezing point and a latent heat of evaporation.

In the above molecular formula (I), examples of the bond of the p-number of carbon atoms shown by $C_p$ may include carbon-carbon single bonds, unsaturated bonds such as carbon-carbon double bonds, and carbon-oxygen double bonds. The carbon-carbon unsaturated bond is preferably a carbon-carbon double bond for reasons of stability. The number of the carbon-carbon unsaturated bond is at least one and is preferably 1.

In the above molecular formula (I), preferred examples of the bond of the q-number of oxygen atoms shown by $O_q$ may include those derived from ether groups, hydroxyl groups and carbonyl groups. The number q of the oxygen atom may be 2. Thus, molecules having two ether groups, hydroxyl groups, etc. are included in the above molecule.

When q of $O_q$ is zero, namely when no oxygen is contained in the molecule, p should be 2 to 6. The molecule should contain at least one unsaturated bond such as a carbon-carbon double bond. Namely, at least one of the bonds of the p-number of carbon atoms represented by $C_p$ must be a carbon-carbon unsaturated bond.

In the above molecular formula (I), R represents Cl, Br, I or H and may be any one of them. In order to reduce tendency to destroy the ozone layer, R is preferably H.

Illustrative of suitable fluorine-containing organic compounds represented by the above molecular formula (I) are unsaturated fluorinated hydrocarbons, fluorinated ether compounds, fluorinated alcohol compounds and fluorinated ketone compound as described previously.

These compounds will be described below.

[Unsaturated Fluorinated Hydrocarbon Compound]

As the unsaturated fluorinated hydrocarbon compound used in the present invention as a refrigerant of refrigerators, there may be mentioned, for example, unsaturated fluorinated hydrocarbon compounds of the above molecular formula (I) in which R is H, p is 2 to 6, q is 0, r is 1 to 12 and s is 0 to 11.

Preferred examples of such an unsaturated fluorinated hydrocarbon compound include fluorinated derivatives of $C_2$ to $C_6$ straight chained or branched chained olefins and $C_4$ to $C_6$ cyclic olefins.

Concrete examples of the unsaturated fluorinated hydrocarbon compound include ethylenes into which 1 to 3 fluorine atoms have been introduced, propenes into which 1 to 5 fluorine atoms have been introduced, butenes into which 1 to 7 fluorine atoms have been introduced, pentenes into which 1 to 9 fluorine atoms have been introduced, hexenes into which 1 to 11 fluorine atoms have been introduced, cyclobutene into which 1 to 5 fluorine atoms have been introduced, cyclopentene into which 1 to 7 fluorine atoms have been introduced and cyclohexene into which 1 to 9 fluorine atoms have been introduced.

Among the above unsaturated fluorinated hydrocarbon compounds, $C_2$ to $C_3$ unsaturated fluorinated hydrocarbon compounds are preferred. More preferred are fluorinated propenes. As the fluorinated propenes, there may be mentioned various isomers of pentafluoropropene, 3,3,3-trifluoropropene, and 2,3,3,3-tetrafluoropropene. Particularly preferred are 1,2,3,3,3-pentafluoropropene (HFC1225ye) and 2,3,3,3-tetrafluoropropene (HFC1234yf).

In the present invention, the unsaturated fluorinated hydrocarbon compounds may be used singly or in combination of two or more thereof.

Also suitably used is a combination of a $C_1$ to $C_2$ saturated fluorinated hydrocarbon refrigerant with a $C_3$ unsaturated fluorinated hydrocarbon refrigerant. Examples of such a combination include a combination of the above-mentioned HFC1225ye with $CH_2F_2$ (HFC32), a combination of HFC1225ye with $CHF_2CH_3$ (HFC152a) and a combination of the above-mentioned HFC1234yf with $CF_3I$.

[Fluorinated Ether Compound]

As the fluorinated ether compound used in the present invention as a refrigerant for refrigerators, there may be mentioned, for example, fluorinated ether compounds of the above molecular formula (I) in which R is H, p is 2 to 6, q is 1 to 2, r is 1 to 14 and s is 0 to 13.

Preferred examples of such a fluorinated ether compound include fluorinated derivatives of $C_2$ to $C_6$ aliphatic ethers having 1 to 2 ether bonds and straight chained or branched alkyl groups, and fluorinated derivatives of $C_3$ to $C_6$ cyclic aliphatic ethers having 1 to 2 ether bonds.

Concrete examples of the fluorinated ether compound include dimethyl ethers into which 1 to 6 fluorine atoms have been introduced, methyl ethyl ethers into which 1 to 8 fluorine atoms have been introduced, dimethoxyethanes into which 1 to 8 fluorine atoms have been introduced, methyl propyl ethers into which 1 to 10 fluorine atoms have been introduced, methyl butyl ethers into which 1 to 12 fluorine atoms have been introduced, ethyl propyl ethers into which 1 to 12 fluorine atoms have been introduced, oxetanes into which 1 to 6 fluorine atoms have been introduced, 1,3-dioxolans into which 1 to 6 fluorine atoms have been introduced and tetrahydrofuranes into which 1 to 8 fluorine atoms have been introduced.

Specific examples of the fluorinated ether compound include hexafluorodimethyl ether, pentafluorodimethyl ether, bis(difluoromethyl)ether, fluoromethyl trifluoromethyl ether, trifluoromethyl methyl ether, perfluorodimethoxymethane, 1-trifluoromethoxy-1,1,2,2-tetrafluoroethane, difluoromethyoxypentafluoroethane, 1-trifluoromethoxy-1,2,2,2-tetrafluoroethane, 1-difluoromethoxy-1,1,2,2-tetrafluoroethane, 1-difluoromethoxy-1,2,2,2-tetrafluoroethane, 1-trifluoromethoxy-2,2,2-trifluoroethane, 1-difluoromethoxy-2,2,2-trifluoroethane, perfluorooxetane, perfluoro-1,3-dioxolan, various isomers of pentafluorooxetane and various isomers of tetrafluorooxetane.

In the present invention, the fluorinated ether compounds may be used singly or in combination of two or more thereof.

[Fluorinated Alcohol Compound]

As the fluorinated alcohol compound used in the present invention as a refrigerant for refrigerators, there may be mentioned, for example, fluorinated alcohol compounds of the above molecular formula (I) in which R is H, p is 1 to 6, q is 1 to 2, r is 1 to 13 and s is 1 to 13.

Preferred examples of such a fluorinated alcohol compound include fluorinated derivatives of $C_1$ to $C_6$ straight chained or branched aliphatic alcohols having 1 to 2 hydroxyl groups.

Concrete examples of the fluorinated alcohol compound include methyl alcohols into which 1 to 3 fluorine atoms have been introduced, ethyl alcohols into which 1 to 5 fluorine atoms have been introduced, propyl alcohols into which 1 to 7 fluorine atoms have been introduced, butyl alcohols into which to 9 fluorine atoms have been introduced, pentyl alcohols into which 1 to 11 fluorine atoms have been introduced, ethylene glycols into which 1 to 4 fluorine atoms have been introduced and propylene glycols into which 1 to 6 fluorine atoms have been introduced.

Specific examples of the fluorinated alcohol compound include monofluoromethyl alcohol, difluoromethyl alcohol, trifluoromethyl alcohol, various isomers of difluoroethyl alcohol, various isomers of trifluoroethyl alcohol, various isomers of tetrafluoroethyl alcohol, pentafluoroethyl alcohol, various isomers of difluoropropyl alcohols, various isomers of trifluoropropyl alcohols, various isomers of tetrafluoropropyl alcohols, various isomers of pentafluoropropyl alcohols, various isomers of hexafluoropropyl alcohols, heptafluoropropyl alcohols, various isomers of difluorobutyl alcohols, various isomers of trifluorobutyl alcohols, various isomers of tetrafluorobutyl alcohols, various isomers of pentafluorobutyl alcohols, various isomers of hexafluorobutyl alcohols, various isomers of hepafluorobutyl alcohols, various isomers of octafluorobutyl alcohols, nonafluorobutyl alcohols, various isomers of difluoroethylene glycol, trifluoroethylene glycol, tetrafluoroethylene glycol; fluorinated propylene glycols such as various isomers of difluoropropylene glycol, various isomers of trifluoropropylene glycol, various isomers of tetrafluoropropylene glycol, various isomers of pentafluoropropylene glycol and hexafluoropropylene glycol; and fluorinated trimethylene glycols corresponding to the above fluorinated propylene glycols.

In the present invention, the fluorinated alcohol compounds may be used singly or in combination of two or more thereof.

[Fluorinated Ketone Compound]

As the fluorinated ketone compound used in the present invention as a refrigerant for refrigerators, there may be mentioned, for example, fluorinated ketone compounds of the above molecular formula (I) in which R is H, p is 2 to 6, q is 1 to 2, r is 1 to 12 and s is 0 to 11.

Preferred examples of such a fluorinated ketone compound include fluorinated derivatives of $C_3$ to $C_6$ aliphatic ketones having straight chained or branched alkyl groups.

Concrete examples of the fluorinated ketone compound include acetones into which 1 to 6 fluorine atoms have been introduced, methyl ethyl ketones into which 1 to 8 fluorine atoms have been introduced, diethyl ketones into which 1 to 10 fluorine atoms have been introduced and methyl propyl ketones into which 1 to 10 fluorine atoms have been introduced.

Specific examples of the fluorinated ketone compound include hexafluorodimethyl ketone, pentafluorodimethyl ketone, bis(difluoromethyl)ketone, fluoromethyl trifluoromethyl ketone, trifluoromethyl methyl ketone, perfluoromethyl ethyl ketone, trifluoromethyl 1,1,2,2-tetrafluoroethyl ketone, difluoromethyl pentafluoroethyl ketone, trifluoromethyl 1,1,2,2-tetrafluoroethyl ketone, difluoromethyl 1,1,2,2-tetrafluoroethyl ketone, difluoromethyl 1,2,2,2-trifluoroethyl ketone, trifluoromethyl 2,2,2-trifluoroethyl ketone and difluoromethyl 2,2,2-trifluoroethyl ketone.

In the present invention, the fluorinated ketone compounds may be used singly or in combination of two or more thereof.

[Saturated Fluorinated Hydrocarbon Compound]

The saturated fluorinated hydrocarbon compound is a refrigerant that may be mixed, if necessary, with at least one fluorine-containing organic compound selected from among the compounds represented by the above molecular formula (I).

As the saturated fluorinated hydrocarbon compound, fluorinated derivatives of $C_1$ to $C_4$ alkanes may be suitably used. Particularly preferred saturated fluorinated hydrocarbon compounds are fluorinated derivatives of $C_1$ to $C_2$ alkanes, e.g. methane and ethane, such as trifluoromethane, difluoromethane, 1,1-difluoroethane, 1,1,1-trifluoroethane, 1,1,2-trifluoroethane, 1,1,1,2-tetrafluoroethane, 1,1,2,2-tetrafluoroethane and 1,1,1,2,2-pentafluoroethane. The saturated fluorinated hydrocarbon compounds may also be those obtained by halogenating the above fluorinated alkanes with halogen atoms other than fluorine, such as trifluoroiodomethane ($CF_3I$). The saturated fluorinated hydrocarbon compounds may be used singly or in combination of two or more thereof.

The compounding amount of the saturated fluorinated hydrocarbon compound is generally 30% by mass or less, preferably 20% by mass or less, more preferably 10% by mass or less, based on the total amount of the refrigerants.

The lubricating oil composition for refrigerators according to the present invention (hereinafter occasionally referred to as "refrigerator oil composition") is a lubricating oil composition for refrigerators that use the above-described refrigerant and contains the following base oil.

Base Oil:

As the base oil for the refrigerator oil composition of the present invention, a polyol ester compound prepared from a polyhydric alcohol selected from among pentaerythritol, dipentaerythritol, trimethylolpropane and neopentyl glycol and a $C_4$ to $C_{20}$ aliphatic monocarboxylic acid.

Among the $C_4$ to $C_{20}$ aliphatic monocarboxylic acids, preferably used are those which have at least 5 carbon atoms, more preferably at least 6 carbon atoms, particularly preferably at least 8 carbon atoms, from the viewpoint of lubricity. From the viewpoint of compatibility with the refrigerant, preferably used are those which have not more than 18 carbon atoms, more preferably not more than 12 carbon atoms, particularly preferably not more than 9 carbon atoms.

The aliphatic monocarboxylic acid may be straight chained or branched. From the viewpoint of lubricity, straight chained aliphatic monocarboxylic acid is preferred. From the viewpoint of stability against hydrolysis, branched aliphatic monocarboxylic acid is preferred.

Further, both saturated aliphatic monocarboxylic acid and unsaturated aliphatic monocarboxylic acid may be used.

As the aliphatic monocarboxylic acid, there may be mentioned straight chained or branched aliphatic monocarboxylic acids such as pentanoic acid, hexanoic acid, heptanoic acid, octanoic acid, nonanoic acid, decanoic acid, undecanoic acid, dodecanoic acid, tridacanoic acid, tetradecanoic acid, pentadecanoic acid, hexadecanoic acid, heptadecanoic acid, octadecanoic acid, nonadecanoic acid, icosanoic acid and oleic acid, and so called neo acids having a quaternary α-carbon atom. More specifically, illustrative of suitable aliphatic monocarboxylic acid are valeric acid (n-pentanoic acid), caproic acid (n-hexanoic acid),
enanthic acid (n-heptanoic acid), caprylic acid (n-octanoic acid), pelargonic acid (n-nonanoic acid), capric acid (n-decanoic acid), oleic acid (cis-9-octadecenoic acid), isopentanoic acid (3-methylbutanoic acid), 2-methylhexanoic acid, 2-ethylpentanoic acid, 2-ethylhexanoic acid and 3,5,5-trimethylhexanoic acid.

The polyol ester compound may be a partial ester in which not all hydroxyl groups are esterified, a complete ester in which all hydroxyl groups are esterified or a mixture of the partial ester and the complete ester. The complete ester is preferred, however.

When the ester of a polyhydric alcohol selected from among pentaerythritol, dipentaerythritol, trimethylolpropane and neopentyl glycol with the above-described aliphatic monocarboxylic acid is a di- or higher ester, such an ester may be an ester of mixed aliphatic monocarboxylic acids and the polyhydric alcohol. Such an ester has excellent low temperature properties and compatibility with the refrigerant.

The base oil used in the refrigerator oil composition of the present invention as the (A) component contains at least one kind of the above-described polyol ester compounds as a main component. As used herein, the term "contains as a main component" is intended to mean that the polyol ester compound is contained in an amount of at least 50% by mass. The content of the polyol ester compound in the base oil is preferably at least 70% by mass, more preferably at least 90% by mass, still more preferably 100% by mass.

The base oil used in the present invention is particularly suited for the above-described unsaturated fluorinated hydrocarbon refrigerant.

The base oil used in the present invention preferably has a kinematic viscosity at 100° C. of 2 to 50 $mm^2/s$, more preferably 3 to 40 $mm^2/s$, still more preferably 4 to 30 $mm^2/s$. A kinematic viscosity of 2 $mm^2/s$ or more can achieve suitable lubricating performance (load carrying property) as well as good sealing property. A kinematic viscosity of 50 $mm^2/s$ or less can provide good energy saving property.

It is preferred that the base oil have a molecular weight of 300 or more, more preferably 500 to 3,000, still more preferably 600 to 2,500. The base oil preferably has a flash point of at least 200° C. When the molecular weight of the base oil is 300 or more, desired performance as a refrigerator oil can be obtained and, at the same time, a flash point of at least 200° C. may be achieved. From the standpoint of stability against oxidation, the base oil preferably has an amount of evaporation of 5% by mass or less. The amount of evaporation herein is as measured according to heat stability test (JIS K 2540).

In the present invention, the base oil may contain other base oil components in addition to the polyol ester compound in the amount of not more than 50% by mass, preferably not more than 30% by mass, more preferably not more than 10% by mass, as long as the above properties are ensured. It is still more preferred that the "other base oils" be not contained.

As the base oil usable together with the polyol ester compound, there may be mentioned, for example, polyoxyalkylene glycols, polyvinyl ethers, copolymers of a poly(oxy) alkylene glycol or its monoether with a polyvinyl ether, other polyesters, polycarbonates, hydrogenated α-olefin oligomers, mineral oils, alicyclic hydrocarbon compounds and alkylated aromatic hydrocarbon compounds.

The refrigerator oil composition of the present invention is suited for the above-described unsaturated fluorinated hydrocarbon refrigerant. However, because of its an olefinic structure, the refrigerant cannot show satisfactory stability by itself. Thus, in order to improve the stability, the refrigerator oil composition should be compounded with a specific phosphorus-based additive as (B) component and a specific acid scavenger as (C) component.

Additives:

[Phosphorus-Based Additive]

As the phosphorus-based additive, a phosphoric acid triester and a phosphorous acid triester may be used. As the phosphoric acid triester, there may be mentioned, for example, triaryl phosphates, trialkyl phosphates, trialkylaryl phosphates, triarylalkyl phosphates and trialkenyl phosphates. Specific examples of the phosphoric acid triester include triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, di(ethylphenyl)phenyl phosphate, propylphenyldiphenyl phosphate, di(propylphenyl)phenyl phosphate, tris(ethylphenyl)phosphate, tris(isopropylphenyl)phosphate, butylphenyldiphenyl phosphate, di(butylphenyl)phenyl phosphate, tris(butylphenyl)phosphate, trihexyl phosphate, tris(2-ethylhexyl)phosphate, trisdecyl phosphate, trilauryl phosphate, trimyristyl phosphate, tripalmityl phosphate, tristearyl phosphate and trioleyl phosphate.

Specific examples of the phosphorous acid triester include triethyl phosphite, tributyl phosphite, triphenyl phosphite, tricresyl phosphite, tris(nonylphenyl)phosphite, tris(2-ethylhexyl)phosphite, trisdecyl phosphite, trilauryl phosphite, triisooctyl phosphite, diphenylisodecyl phosphite, tristearyl phosphite and trioleyl phosphite.

In the present invention, these phosphorus-based additives may be used singly or in combination with two or more thereof. The compounding amount of the phosphorus-based additive is generally 0.1 to 3% by mass, preferably 0.3 to 2% by mass, based on the total amount of the composition.

[Acid Scavenger]

As the acid scavenger, at least one member selected from among glycidyl esters, glycidyl ethers and α-olefin oxides is used.

As the glycidyl ester, there may be mentioned glycidyl esters, having generally 3 to 30, preferably 4 to 24, more preferably 6 to 16 carbon atoms, of saturated or unsaturated, straight chained, branched or cyclic aliphatic carboxylic acids or aromatic carboxylic acids. The aliphatic carboxylic acids and aromatic carboxylic acids may be monocarboxylic acids or polycarboxylic acid. In the case of the polycarboxylic acid, it is preferred that all of the carboxyl groups thereof be esterified with glycidyl groups from the viewpoint of prevention of an increase of the acid value and stability of the lubricating oil composition.

Among the glycidyl esters, especially preferred are glycidyl esters of $C_6$ to $C_{16}$ straight chained, branched or cyclic saturated aliphatic monocarboxylic acids. Examples of such a glycidyl ester include a glycidyl ester of 2-ethylhaxanoic acid, a glycidyl ester of 3,5,5-trimethylhexanoic acid, a glycidyl ester of capric acid, a glycidyl ester of lauric acid, a glycidyl ester of versatic acid and a glycidyl ester of myristic acid.

As the glycidyl ether, there may be mentioned glycidyl ethers having generally 3 to 30, preferably 4 to 24, more preferably 6 to 16 carbon atoms and derived from saturated or unsaturated, straight chained, branched or cyclic aliphatic monohydric or polyhydric alcohols or from aromatic compounds having at least one hydroxyl group. In the case of aliphatic polyhydric alcohols or aromatic compounds having two or more hydroxyl groups, it is preferred that all of the hydroxyl groups thereof be etherified with glycidyl groups from the viewpoint of prevention of an increase of the acid value and stability of the lubricating oil composition.

Among the glycidyl ethers, especially preferred are glycidyl ethers of $C_6$ to $C_{16}$ straight chained, branched or cyclic saturated aliphatic monohydric alcohols. Examples of such a glycidyl ether include 2-ethylethyl glycidyl ether, isononyl glycidyl ether, caprynoyl glycidyl ether, lauryl glycidyl ether and myristyl glycidyl ether.

As the α-olefin oxide, there may be used α-olefin oxides having generally 4 to 50, preferably 4 to 24, more preferably 6 to 16 carbon atoms.

In the present invention the above-described acid scavengers may be used singly or in combination of two or more thereof. The compounding amount of the acid scavenger is generally in the range of 0.005 to 10% by mass, particularly preferably 0.05 to 6% by mass, based on the total amount of the composition, from the standpoint of the scavenging effect and suppression of sludge formation.

The refrigerator oil composition of the present invention may contain at least one additive selected from among another extreme pressure agent than that described above, an oiliness agent, an antioxidant, another acid scavenger than that described above and an anti-foaming agent as long as the present invention maintains its effect.

As the "another extreme pressure agent than that described above", there may be mentioned phosphorus-based extreme pressure agents such as acid phosphates, acid phosphites and amine salts of them.

As the "another extreme pressure agent than that described above", there may also be mentioned carboxylic acid metal salts. The term "carboxylic acid metal salts" as used herein is intended to refer to metal salts of carboxylic acids having preferably 3 to 60 carbon atoms, more preferably 3 to 30 carbon atoms, particularly preferably metal salts of fatty acids having 12 to 30 carbon atoms. There may also be mentioned metal salts of dimer acids and trimer acids of the above-described fatty acids and metal salts of dicarboxylic acids having 3 to 30 carbon atoms. Above all, metal salts of $C_{12}$ to $C_{30}$ fatty acids and $C_3$ to $C_{30}$ dicarboxylic acids are particularly preferred.

As the metal constituting the above metal salts, alkali metals and alkaline earth metals are preferred. Particularly preferred are alkali metals.

As the "another extreme pressure agent than that described above", there may also be mentioned, for example, sulfur-based extreme pressure agents such as sulfurized fats and oils, sulfurized fatty acids, sulfurized esters, sulfurized olefins, dihydrocarbyl polysulfides, thiocarbamates, thioterpenes and dialkyl thiodipropionates.

As the "another acid scavenger than that described above", there may be mentioned, for example, cyclohexene oxide and epoxidized soybean oil.

Examples of the oiliness agent include saturated or unsaturated aliphatic monocarboxylic acids such as stearic acid and oleic acid, polymerized fatty acids such as dimer acids and hydrogenated dimer acids, hydroxy fatty acids such as ricinoleic acid and 12-hydroxystearic acid, saturated or unsaturated aliphatic monoalcohols such as lauryl alcohol and oleyl alcohol, saturated or unsaturated aliphatic monoamines such as stearyl amine and oleyl amine, saturated or unsaturated aliphatic monocarboxylic acid amides such as lauramide and oleamide, and partial esters of polyhydric alcohols such as glycerol and sorbitol with saturated or unsaturated aliphatic monocarboxylic acids.

These oiliness agents may be used singly or in combination of two or more thereof. The compounding amount of the oiliness agent is generally in the range of 0.01 to 10% by mass, preferably 0.1 to 5% by mass, based on the total amount of the composition.

As the antioxidant, there may be preferably used phenol-based antioxidants such as 2,6-di-tert-butyl-4-methylphenol, 2,6-di-tert-butyl-4-ethylphenol and 2,2'-methylenebis(4-methyl-6-tert-butylphenol) and amine-based antioxidants such as phenyl-α-naphthylamine and N,N'-diphenyl-p-phenylenediamine. The compounding amount of the antioxidant is generally 0.01 to 5% by mass, preferably 0.05 to 3% by mass, based on the total amount of the composition from the standpoint of the anti-oxidizing effect and economy.

As the anti-foaming agent, there may be mentioned, for example, silicone oil and fluorinated silicone oil.

The refrigerator oil composition of the present invention may be further compounded with various other known additives such as copper deactivator, e.g. N—[N,N'-dialkyl($C_3$ to $C_{12}$ alkyl)aminomethyl]triazole, as long as the objects of the present invention are not adversely affected.

The refrigerator oil composition of the present invention may be suitably applied to such refrigerators that use a refrigerant containing at least one fluorine-containing organic compound selected from among compounds represented by the above molecular formula (I) or a combination of the fluorine-containing organic compound with a saturated fluorinated hydrocarbon compound, and is particularly suited for use in refrigerators that use a refrigerant containing an unsaturated fluorinated hydrocarbon compound.

In the method of lubricating the refrigerators using the refrigerator oil composition of the present invention, the using amount of the above-described various refrigerants and the refrigerator oil composition is preferably such that a mass ratio of the refrigerant to the refrigerator oil composition is in the range of 99:1 to 10:90, more preferably 95:5 to 30:70. When the amount of the refrigerant is less than the above-specified range, the refrigerating performance tends to be deteriorated. When the amount of the refrigerant is greater than the above-specified range, the lubricating performance tends to be undesirably deteriorated. The refrigerator oil composition of the present invention may be applied to various refrigerators and may be particularly suitably used in a compression refrigerating cycle of compression-type refrigerators.

The refrigerators to which the refrigerator oil composition of the present invention is applicable has a refrigerating cycle including, as its essential components, a combination of a compressor, a condenser, an expansion system (such as expansion valve) and an evaporator, or a combination of a compressor, a condenser, an expansion system, a dryer and an evaporator. These refrigerators use the refrigerator oil composition of the present invention as a refrigerating machine oil and various refrigerants as described above.

The dryer is preferably filled with a drying agent including zeolite having a pore diameter of 0.33 nm or less. Examples of the zeolite include natural zeolite and synthetic zeolite. Particularly suitably used is zeolite having a $CO_2$ gas absorption capacity of 1.0% or less at 25° C. under a $CO_2$ gas partial pressure of 33 kPa. Specific examples of the synthetic zeolite having such an absorption capacity include those available under trade names XH-9 and XH-600 from Union Showa Co., Ltd.

When such a drying agent is used in the present invention, water may be efficiently removed from the refrigerating cycle without absorbing the refrigerant present in the refrigerating cycle. At the same time, such a drying agent itself is prevented from being deteriorated and powdered. Thus, occurrence of clogging of pipes with the powder and abnormal wear due to intrusion of the powder into sliding members of the compressors can be avoided. Therefore, the refrigerators can be operated in a stable manner for a long period of time.

In the refrigerators to which the refrigerator oil composition of the present invention is applied, various sliding members (for example, bearings) are provided within the compressor thereof. In the present invention, these sliding members are preferably made of engineering plastic or provided with an organic coating, film or an inorganic coating film from the standpoint of sealing property, in particular.

As the preferred engineering plastic, there may be mentioned, for example, a polyamide resin, a polyphenylene sulfide resin and a polyacetal resin from the standpoint of sealing property, sliding property and wear resistance.

As the preferred organic coating film, there may be mentioned, for example, a fluorine-containing resin coating film (such as a polytetrafluoroethylene coating film), a polyimide coating film, a polyamide-imide coating film and a thermosetting insulating film formed from a resin coating material containing a resin base material containing a polyhydroxyether resin and a polysulfone-based resin and a cross-linking agent from the standpoint of sealing property, sliding property and wear resistance.

As the preferred inorganic coating film, there may be mentioned, for example, a graphite film, a diamond-like carbon film, a nickel film, a molybdenum film, a tin film and a chromium film from the standpoint of sealing property, sliding property and wear resistance. These inorganic coating films may be formed by a plating method or by a PVD (physical vapor deposition) method.

If desired, the sliding members may be made of a conventional alloy such as a Fe-based alloy, an Al-based alloy and a Cu-based alloy.

The refrigerator oil composition of the present invention may be suitably used in various hot-water supplying systems or refrigeration and heating systems for car air conditioners, electric car air conditioners, gas heat pumps, air conditioners, refrigerators, vending machines or showcases.

In the present invention, the water content in these systems is preferably 300 ppm by mass or less, more preferably 200 ppm by mass or less. The residual air content in the systems is preferably 10 kPa or less, more preferably 5 kPa or less.

The refrigerator oil composition of the present invention contains a specific oxygen-containing compound as a main component of a base oil and has a low viscosity, an improved energy saving property and, yet, an excellent sealing property.

EXAMPLE

The present invention will be next described in more detail by way of examples. The scope of the present invention is, however, not limited to these examples in any way.

The properties of the base oil and various characteristics of the refrigerator oil composition of the present invention are determined in the manner described below.

Properties of Base Oil:

(1) Kinematic Viscosity at 100° C.

The kinematic viscosity was measured using a glass capillary viscometer according to JIS K2283-1983.

(2) Flash Point

The flash point was measured by C.O.C. method according to JIS K2265.

(3) Molecular Weight

The molecular weight is a value calculated on the basis of the chemical structure of each compound constituting the base oil.

Characteristics of Refrigerator Oil Composition:

(4) Stability (Sealed Tube Test)

A metal catalyst composed of iron, copper and aluminum was charged in a glass tube together with a sample oil and a refrigerant with an oil/refrigerant proportion of 4 mL/1 g (water content: 200 ppm), and the glass tube was then sealed. This was allowed to stand at 175° C. under the atmospheric pressure of 26.6 kPa for 30 days. Thereafter, the appearance of the oil, appearance of the catalyst and sludge formation were observed with naked eyes, and an acid value was measured.

The components used for the preparation of the refrigerator oil composition are shown below. The base oil used are A1 to A5. The compound names and properties of the oil are shown in Table 1.

TABLE 1

| Base oil | | Kinematic viscosity at 100° C. | Flash point | Molecular |
|---|---|---|---|---|
| Kind | Chemical name | ($mm^2/s$) | (° C.) | weight |
| A1 | Pentaerythritol octanoate nonanoate ($C_8/C_9$ molar ratio: 1/1.1) | 9.64 | 260 | 669 |
| A2 | Pentaerythritol octanoate nonanoate ($C_8/C_9$ molar ratio: 1/1.7) | 15.99 | — | 675 |
| A3 | Neopentylglycol dioctanoate | 3.54 | — | 356 |
| A4 | Trimethylolpropane trinonanoate | 6.32 | — | 540 |
| A5 | Dipentaerythritol hexahexanoate | 20.25 | — | 842 |

Remarks:
Octanoate: 2-ethylhexanoate
Nonanoate: 3,5,5-trimethylhexanoate

The following compounds were used as additives.

Phosphorus-Based Additives:

B1: Tricresyl phosphate
B2: Tris(isopropylphenyl)phosphate
B3: Tris(nonylphenyl)phosphite
B4: Dicresyl phosphate
B5: Mono(isopropylphenyl)phosphate
B6: Dioleyl hydrogen phosphite Acid Scavenger:

C1: Glycidyl ester of $C_{10}$ carboxylic acid
C2: 2-Ethylhexyl glycidyl ether
C3: $C_{14}$ α-olefin oxide Antioxidant:

D1: 2,6-di-t-butyl-4-methylphenol

Examples 1 to 7 and Comparative Examples 1 to 5

Refrigerator oil compositions having the formulations as shown in Table 2 were prepared and evaluated for the characteristics thereof using HFC1234yf (2,3,3,3-tetrafluoropropene) as a refrigerant. The results are summarized in Table 2.

TABLE 2

| | | | Example | | | | | | |
|---|---|---|---|---|---|---|---|---|---|
| | | | 1 | 2 | 3 | 4 | 5 | 6 | 7 |
| Compounding formulation | Base oil | Kind | A1 | A1 | A1 | A2 | A3 | A4 | A5 |
| | | (% by mass) | 97.5 | 97.5 | 93.5 | 97.5 | 97.5 | 97.5 | 93.5 |
| | Phosphorus-based additive | Kind | B1 | B2 | B3 | B1 | B1 | B2 | B3 |
| | | (% by mass) | 1.0 | 1.0 | 1.0 | 1.0 | 1.0 | 1.0 | 1.0 |
| | Acid scavenger | Kind | C1 | C2 | C3 | C1 | C1 | C2 | C3 |
| | | (% by mass) | 1.0 | 1.0 | 5.0 | 1.0 | 1.0 | 1.0 | 5.0 |
| | Antioxidant | Kind | D1 | D1 | D1 | D1 | D1 | D1 | D1 |
| | | (% by mass) | 0.5 | 0.5 | 0.5 | 0.5 | 0.5 | 0.5 | 0.5 |
| Performance evaluation | Sealed tube test | Oil appearance | good | good | good | good | good | good | good |
| | | Catalyst appearance | good | good | good | good | good | good | good |
| | | Sludge formation | none | none | none | none | none | none | none |
| | | Acid value (mgKOH/g) | 0.01> | 0.01> | 0.02 | 0.01> | 0.01> | 0.01> | 0.03 |

| | | | Comparative example | | | | |
|---|---|---|---|---|---|---|---|
| | | | 1 | 2 | 3 | 4 | 5 |
| Compounding formulation | Base oil | Kind | A1 | A1 | A1 | A2 | A5 |
| | | (% by mass) | 97.5 | 96.5 | 93.5 | 97.5 | 93.5 |
| | Phosphorus-based additive | Kind | B4 | B5 | B6 | B4 | B6 |
| | | (% by mass) | 1.0 | 1.0 | 1.0 | 1.0 | 1.0 |
| | Acid scavenger | Kind | C1 | C2 | C3 | C1 | C3 |
| | | (% by mass) | 1.0 | 2.0 | 5.0 | 1.0 | 5.0 |
| | Antioxidant | Kind | D1 | D1 | D1 | D1 | D1 |
| | | (% by mass) | 0.5 | 0.5 | 0.5 | 0.5 | 0.5 |
| Performance evaluation | Sealed tube test | Oil appearance | brown | Brown | brown | brown | brown |
| | | Catalyst appearance | FeCu tarnished | FeCu tarnished | FeCu tarnished | FeCu tarnished | FeCu tarnished |
| | | Sludge formation | formed | formed | formed | formed | formed |
| | | Acid value (mgKOH/g) | 2.5 | 3.5 | 4.5 | 2.3 | 4.8 |

As will be appreciated from Table 2, the refrigerator oil compositions of the present invention (Examples 1 to 7) show excellent stability in the sealed tube test using the HFC1234yf refrigerant.

INDUSTRIAL APPLICABILITY

The lubricating oil composition for refrigerators according to the present invention is usable for refrigerators using a refrigerant having a specific structure, such as an unsaturated fluorinated hydrocarbon compound, having a low global warming potential and particularly being used in current car air conditioner systems and has excellent compatibility with the refrigerant, good sealing properties, capability of imparting a low coefficient of friction to sliding members and, yet, excellent stability.

The invention claimed is:

1. A lubricating oil composition/refrigerant combination, comprising:

(1) a $C_2$ to $C_3$ unsaturated fluorinated hydrocarbon refrigerant or a combination of $C_1$ to $C_2$ saturated fluorinated hydrocarbon refrigerant with a $C_3$ unsaturated fluorinated hydrocarbon refrigerant, (A) a base oil comprising as a main component a polyol ester compound obtained from a polyhydric alcohol selected from the group consisting of pentaerythritol, dipentaerythritol, trimethylolpropane and neopentyl glycol, and a $C_4$ to $C_{20}$ aliphatic monocarboxylic acid, (B) one phosphorous acid triester selected from the group consisting of tricresyl phosphate, tris(isopropylphenyl) phosphate, and tris(nonylphenyl)phosphate, wherein said one phosphorous acid triester is the sole phosphorous acid triester in the lubricating oil composition/refrigerant combination, and (C) at least one acid scavenger selected from the group consisting of a glycidyl ester, a glycidyl ether, and an α-olefin oxide.

2. The lubricating oil composition/refrigerant combination as recited in claim 1, wherein the base oil (A) has a kinematic viscosity at 100° C. of 2 to 50 $mm^2/s$.

3. The lubricating oil composition/refrigerant combination as recited in claim 1, wherein the base oil (A) has a molecular weight of at least 300.

4. The lubricating oil composition/refrigerant combination as recited in claim 1, wherein the base oil (A) has a flash point of at least 200° C.

5. The lubricating oil composition/refrigerant combination as recited in claim 1, further comprising at least one additive selected from the group consisting of an extreme pressure agent, an oiliness agent, an antioxidant, an acid scavenger and an anti-foaming agent.

6. The lubricating oil composition/refrigerant combination as recited in claim 5, wherein the extreme pressure agent is at least one extreme pressure agent selected from the group consisting of an acid phosphate, an acid phosphite, an amine salt of acid phosphate, an amine salt of acid phosphite, a carboxylic acid metal salt, a sulfurized fat, a sulfurized oil, a sulfurized fatty acid, a sulfurized ester, a sulfurized olefin, a dihydrocarbyl polysulfide, a thiocarbamate, a thioterpene, and a dialkyl thiodipropionate.

7. The lubricating oil composition/refrigerant combination as recited in claim 5, wherein the acid scavenger is at least one acid scavenger selected from the group consisting of cyclohexene oxide and epoxidized soybean oil.

8. The lubricating oil composition/refrigerant combination as recited in claim 1, wherein the refrigerators have a sliding member made of engineering plastic or having an organic coating film or an inorganic coating film.

9. The lubricating oil composition/refrigerant combination as recited in claim 8, wherein the organic coating film is a polytetrafluoroethylene coating film, a polyimide coating film, a polyamide-imide coating film or a thermosetting insulating film formed from a resin coating material, wherein said resin coating material comprises a resin base material comprising a polyhydroxyether resin and a polysulfone-based resin, and a cross-linking agent.

10. The lubricating oil composition/refrigerant combination as recited in claim 8, wherein the inorganic coating film is a graphite film, a carbon film, a tin film, a chromium film, a nickel film or a molybdenum film.

11. The lubricating oil composition/refrigerant combination as recited in claim 1, wherein the unsaturated fluorinated hydrocarbon compound is 1,2,3,3,3-pentafluoropropene (HFC1225ye).

12. The lubricating oil composition/refrigerant combination as recited in claim 1, wherein the unsaturated fluorinated hydrocarbon compound is 2,3,3,3-tetrafluoropropene (HFC1234yf).

13. The lubricating oil composition/refrigerant combination as recited in claim 1, wherein (B) is tricresyl phosphate.

14. The lubricating oil composition/refrigerant combination as recited in claim 1, wherein (B) is tris(isopropylphenyl) phosphate.

15. The lubricating oil composition/refrigerant combination as recited in claim 1, wherein (B) is tris(nonylphenyl) phosphate.

16. The lubricating oil composition/refrigerant combination as recited in claim 1, wherein (1) is the $C_2$ to $C_3$ unsaturated fluorinated hydrocarbon refrigerant.

17. The lubricating oil composition/refrigerant combination as recited in claim 1, wherein (1) is the combination of $C_1$ to $C_2$ saturated fluorinated hydrocarbon refrigerant with a $C_3$ unsaturated fluorinated hydrocarbon refrigerant.

18. The lubricating oil composition/refrigerant combination as recited in claim 1, which comprises 0.3 to 2% by mass of (B).

19. The lubricating oil composition/refrigerant combination as recited in claim 1, which consists of (1), (A), (B), and (C).

20. The lubricating oil composition/refrigerant combination as recited in claim 1, which consists of (1), (A), (B), (C) and, optionally, one or more additives selected from the group consisting of an extreme pressure agent, an oiliness agent, an antioxidant, an additional acid scavenger, and an anti-foaming agent.

21. The lubricating oil composition/refrigerant combination as recited in claim 1, wherein the base oil comprises at least one member selected from the group consisting of pentaerythritol octanoate nonanoate with a C8/C9 molar ratio of 1/1, pentaerythritol octanoate nonanoate with a C8/C9 molar ratio of 1/1.7, neopentylglycol dioctanoate, trimethylolpropane trinonanoate, and dipentaerythritol hexahexanoate.

22. The lubricating oil composition/refrigerant combination as recited in claim 1, which is incorporated in a hot-water supply system or a refrigeration and heating system for car air conditioners, an electric car air conditioner, a gas heat pump, an air conditioner, a refrigerator, a vending machine or a showcase.

23. The lubricating oil composition/refrigerant combination as recited in claim 22, wherein a water content and a residual air content within each of the systems are 300 ppm by mass or less and 10 kPa or less, respectively.

24. A method of preparing the lubricating oil composition/refrigerant combination as recited in claim 1, comprising combining (1), (A), (B), and (C).

* * * * *